United States Patent [19]

Taves

[11] Patent Number: 5,054,675

[45] Date of Patent: Oct. 8, 1991

[54] TISSUE DISPENSER

[76] Inventor: Bill Taves, 150 Quail Glen, Felton, Calif. 95018

[21] Appl. No.: 486,285

[22] Filed: Feb. 28, 1990

[51] Int. Cl.[5] ..... A47K 10/32

[52] U.S. Cl. ..... 225/20; 225/79; 225/77; 225/19

[58] Field of Search ..... 225/22, 23, 26, 77, 225/89, 19, 20, 79, 81, 61, 25; 242/55.2; 206/389

[56] References Cited

U.S. PATENT DOCUMENTS

| | | | |
|---|---|---|---|
| 316,368 | 4/1885 | Johnson | 225/22 |
| 320,576 | 6/1885 | Myers | 225/89 |
| 379,444 | 3/1888 | Booth et al. | 225/79 |
| 427,246 | 5/1890 | Wilson | 225/89 |

*Primary Examiner*—Mark Rosenbaum

*Assistant Examiner*—Allan M. Schrock

*Attorney, Agent, or Firm*—Leon Gilden

[57] ABSTRACT

Apparatus including a U-shaped bracket supporting an axle mounting a roll of tissue thereon. A triangular cross-sectional elongate abutment member that includes an elongate projecting edge oriented parallel to and below the axis of the roll of tissue mounted rearwardly thereof against a support surface mounting the tissue dispenser. Modification of the instant invention include an elongate serrated edge associated with a manual grasp bar the displacement of the serrated edge prior to removal of a preselected length of tissue from the roll. The serrated edge may optionally include a resilient deformable engagement strip preventing access of a leading edge of the tissue roll to the serrated edge until downward pressure displaces the strip to expose the underlying serrated edge.

3 Claims, 4 Drawing Sheets

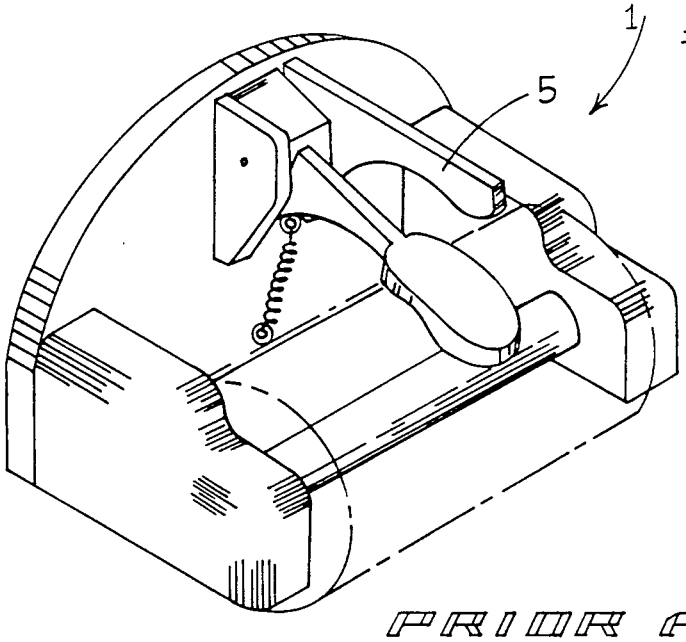
FIG 1
PRIOR ART
FIG 2
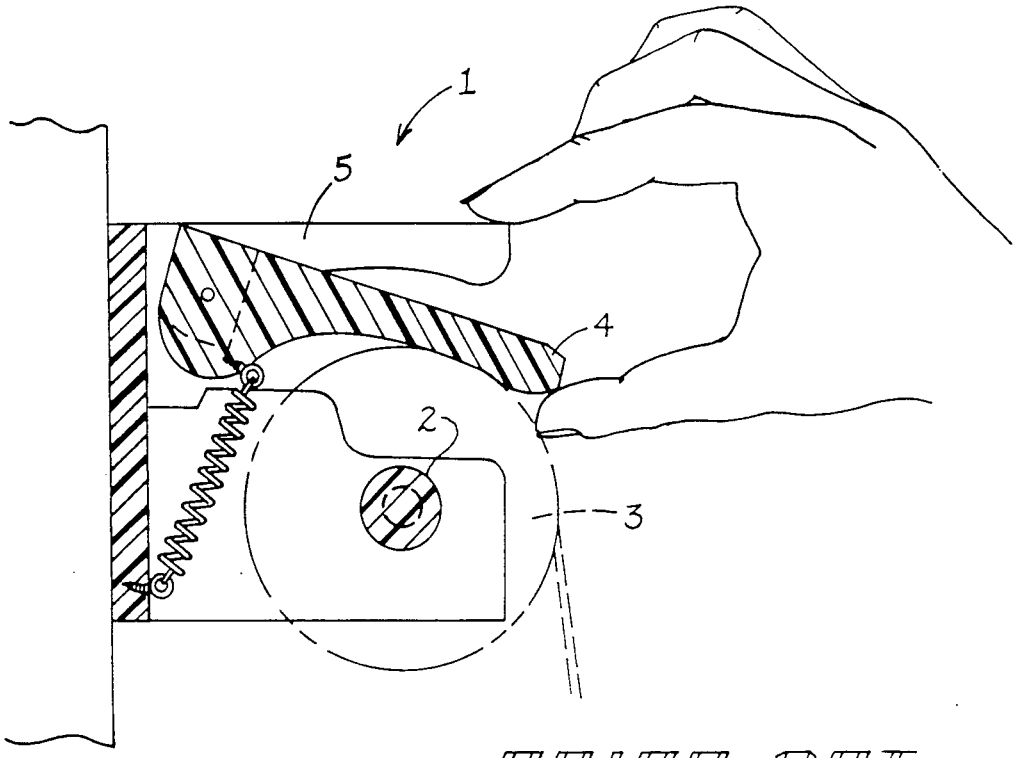
PRIOR ART

Fig 3
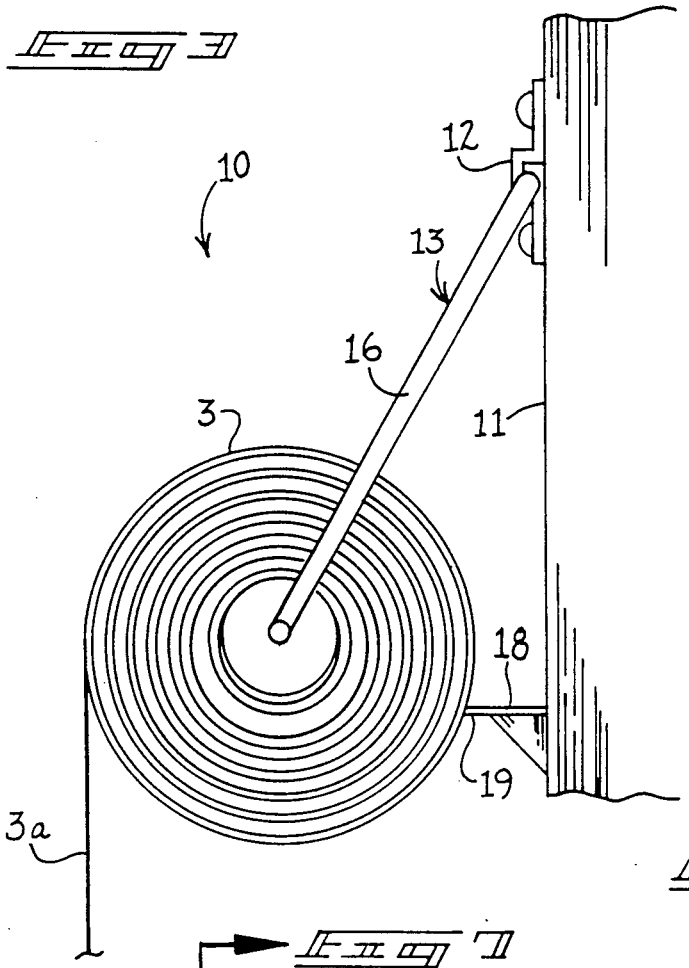
Fig 4
Fig 7
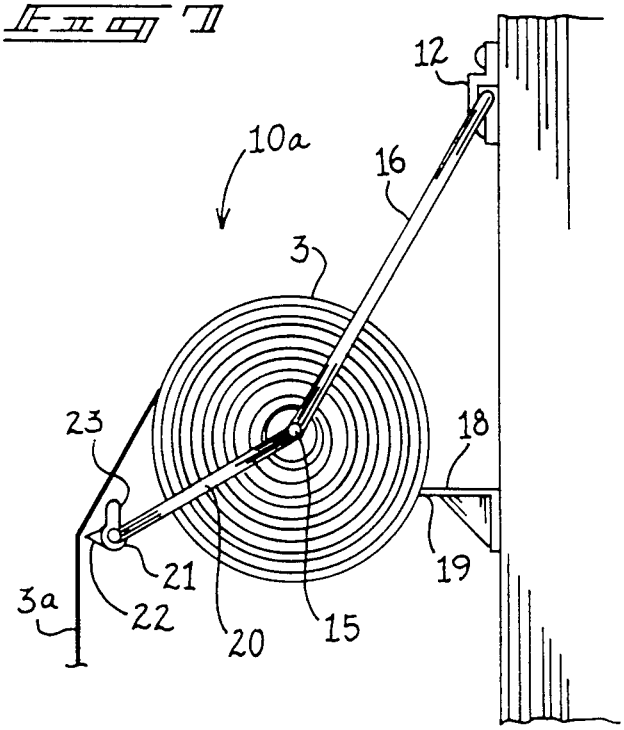
Fig 7

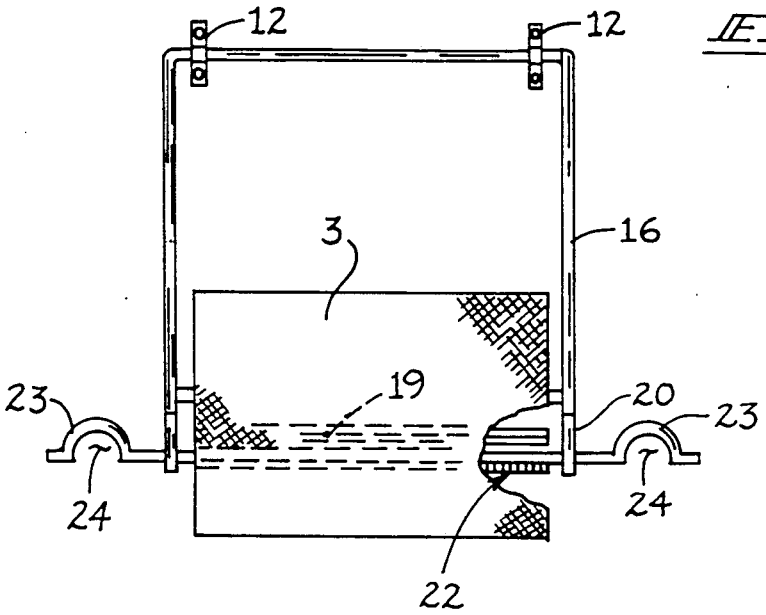
FIG 7
FIG 8
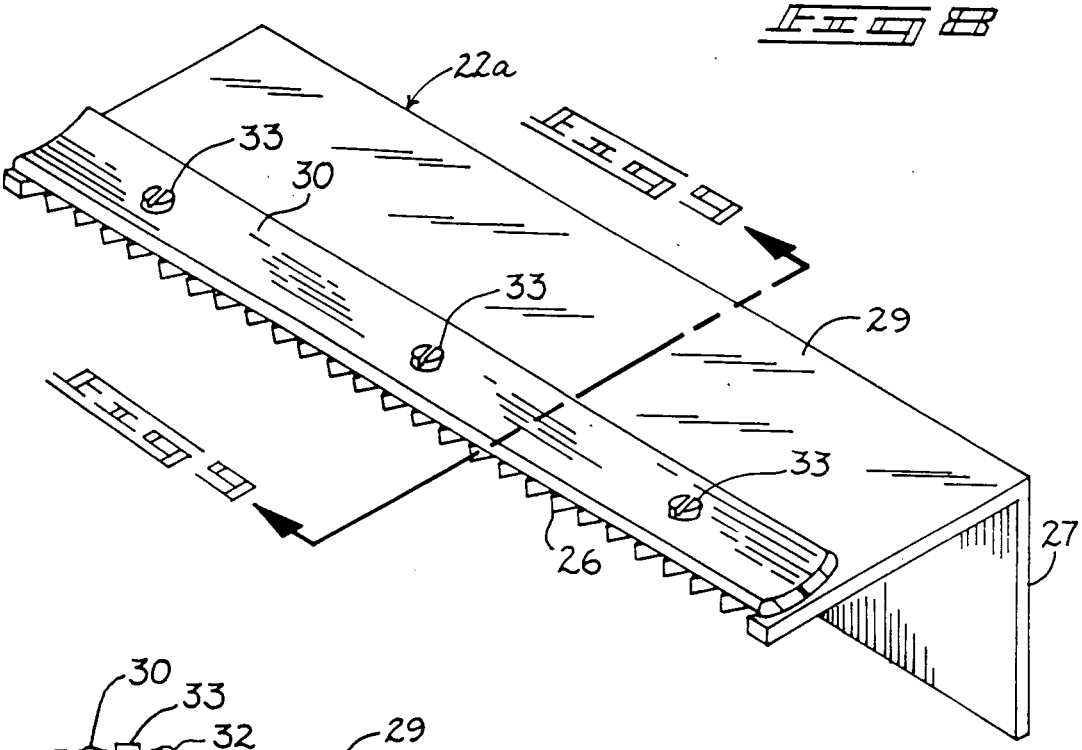
FIG 9
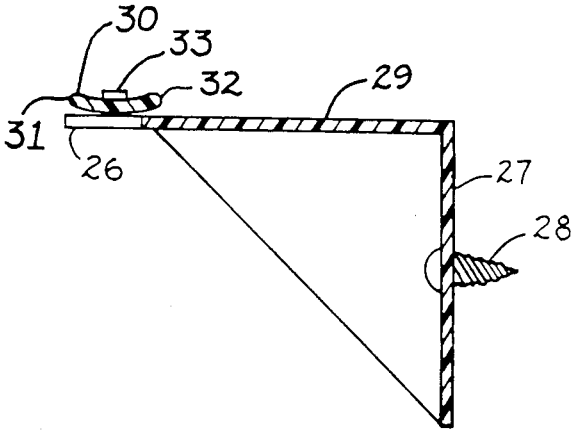
FIG 9

TISSUE DISPENSER

BACKGROUND OF THE INVENTION

1. Field of the Invention

The field of the invention relates to tissue dispensers, and more particularly pertains to a new and improved tissue dispenser wherein the same maintains and positions a roll of tissue paper relative to a support axle preventing inadvertent unwinding of the roll during use.

2. Description of the Prior Art

Various tissue dispensers and organizations are available in the prior art. Tissue dispensers have included short-comings of permitting unnecessary unwinding of a roll of tissue during a separation or removal procedure of tissue from the roll. Prior art organizations to minimize this aspect of tissue removal from a roll have included elaborate organizations to effect a braking of the roll. Examples of prior include U.S. Pat. No. 2,749,056 top JENKINS wherein a tissue roll mounted upon an axle includes an overlying spring biased abutment and an adjacent bar to permit repositioning of the abutment relative to the roll.

U.S. Pat. No. 4,610,407 to STUBBMANN sets forth a frictional drag arrangement for a roll of tissue mounted within the core of the tissue roll.

U.S. Pat. No. 4,285,474 to PEREZ sets forth a tissural dispenser wherein a rearwardly mounted engagement plate is biased against a rear surface of the roll to prevent undue unwinding of the roll.

U.S. Pat. No. 3,850,379 to STERN wherein a spring clip directs pressure against an end surface of the roll to prevent undue unwinding thereof.

U.S. Pat. No. 3,170,652 to KENNEDY provides an adjustable tension member mounted within the core of the roll to adjust the level of force required to unwind the associated roll.

As such, it may be appreciated that there continues to be a need for a new and improved tissue dispenser that addresses both the problems of ease of use, as well as effectiveness in construction to prevent inadvertent unwinding of a roll of tissue and in this respect, the present invention substantially fulfills this need.

SUMMARY OF THE INVENTION

In view of the foregoing disadvantages inherent in the known types of tissue dispenser now present in the prior art, the present invention provides a new and improved tissue dispenser wherein the same provides an abutment member to prevent undue unwinding of the roll as well as improved serrated blade construction to provide selective removal of a length of tissue from an associated roll. As such, the general purpose of the present invention, which will be described subsequently in greater detail, is to provide a new and improved tissue dispenser which has all the advantages of the prior art tissue dispenser and none of the disadvantages.

Tissue dispenser organization of the instant invention essentially includes apparatus including a U-shaped bracket supporting an axle mounting a roll of tissue thereon. A triangular cross-sectional elongate abutment member includes an elongate projecting edge oriented parallel to and below the axis of the roll of tissue mounted rearwardly thereof against a support surface of the tissue dispenser. Modification of the instant invention include an elongate serrated edge associated with a manual grasp bar for displacement of the serrated edge prior to removal of a preselected length of tissue from the roll. The serrated edge may optionally include a resilient deformable engagement strip preventing access of a leading edge of the tissue roll access to the serrated edge until downward pressure displaces the strip to expose the underlying serrated edge.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tissue dispenser which has all the advantages of the prior art tissue dispenser and none of the disadvantages.

It is another object of the present invention to provide a new and improved tissue dispenser which may be easily and efficiently manufactured and marketed.

It is a further object of the present invention to provide a new and improved tissue dispenser which is of a durable and reliable construction.

An even further object of the present invention is to provide a new and improved tissue dispenser which is susceptible of a low cost of manufacture with regard to both materials and labor, and which accordingly is then susceptible of low prices of sale to the consuming public, thereby making such tissue dispensers economically available to the buying public.

Still yet another object of the present invention is to provide a new and improved tissue dispenser which provides in the apparatuses and methods of the prior art some of the advantages thereof, while simultaneously overcoming some of the disadvantages normally associated therewith.

Still another object of the present invention is to provide a new and improved tissue dispenser which may be compactly stored when not being utilized.

Yet another object of the present invention is to provide a new and improved tissue dispenser wherein the same provides a passive abutment to prevent unwinding of a roll of tissue.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art tissue dispenser.

FIG. 2 is an orthographic cross-sectional view of the tissue dispenser of FIG. 1.

FIG. 3 is an orthographic side view taken in elevation of the tissue dispenser of the instant invention.

FIG. 4 is an orthographic side view of a modification of the instant invention.

FIG. 7 is an orthographic view taken along the lines 7—7 of FIG. 4 in the direction indicated by the arrows.

FIG. 8 is an isometric illustration of a modified blade structure utilized by the instant invention.

FIG. 9 is an orthographic view taken along the lines 9—9 of FIG. 8 in the direction indicated by the arrows.

DESCRIPTION OF THE PREFERRED EMBODIMENT

Figure 5:
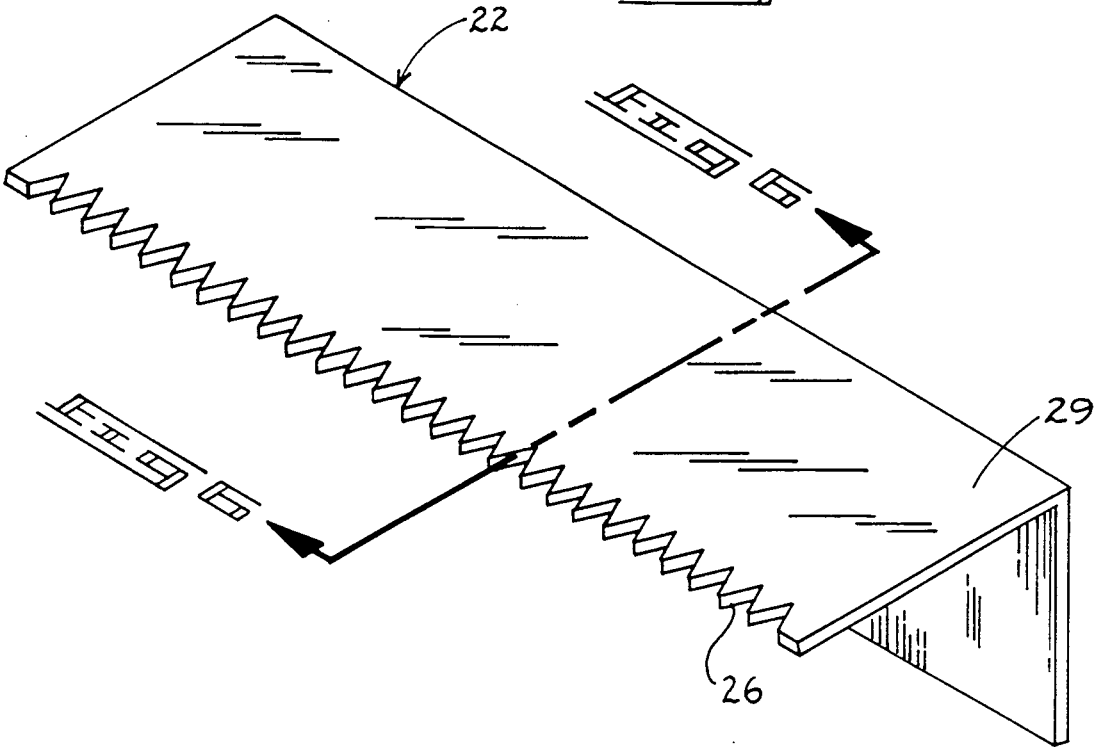
FIG. 5 is an isometric illustration of the blade structure utilized by the instant invention.
Figure 6:
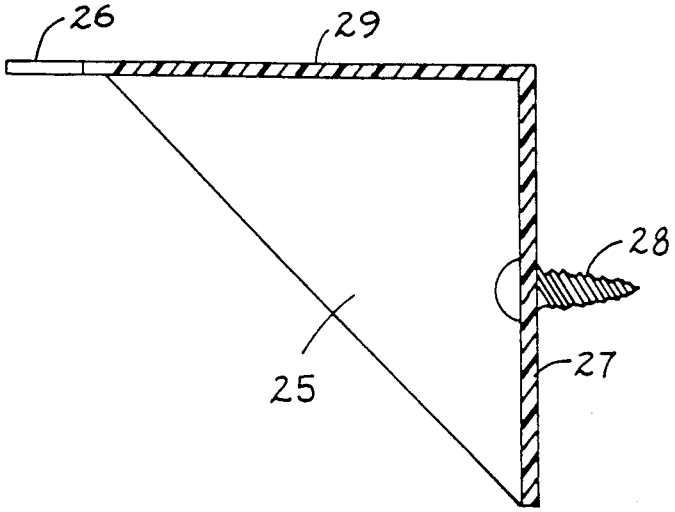
FIG. 6 is an orthographic cross-sectional view taken along the lines 6—6 of FIG. 5 in the direction indicated by the arrows.

With reference now to the drawings, and in particular to FIGS. 1 to 9 thereof, a new and improved tissue dispenser embodying the principles and concepts of the present invention and generally designated by the reference numerals 10 and 10*a* will be described.

FIG. 1 is illustrative of a prior art tissue dispenser 1 including an axle 2 rotatably mounted between spaced arms to rotatably mount a roll of tissue 3 thereon with a friction abutment plate 4 overlying and biased downwardly upon the roll 3 with a rigid bar 5 directed in overlying relationship relative to the plate 4 and the roll to permit an individual to simultaneously grasp the bar and the plate to displace the plate from engagement with the roll 3.

More specifically, the tissue dispenser 10 of the instant invention essentially comprises a plurality of spaced U-shaped brackets 12 to secure a base leg 17 of a U-shaped support frame 13 between the brackets 12 and a vertical support surface 11. The U-shaped support frame 13 includes spaced side legs 16 mounted orthogonally and downwardly from each terminal end of the base leg 17 with each side leg 16 including an aperture 15 directed orthogonally through and adjacent a lower terminal end of each side leg. The apertures 15 of each side leg 16 are coaxially aligned relative to one another and parallel to the base leg 17. A tissue support axle 14 is accordingly directed through the aligned apertures 15 to mount a roll of tissue 3 thereon with a free end portion 3*a* directed downwardly and forwardly of the roll spaced from the axle 14. A frictional abutment 18 of a triangular cross-sectional configuration is mounted on the support surface 11 underlying the base leg 17 and positioned vertically below the aligned apertures 15 and associated support axle 14 to enhance engagement of an engagement edge 19 oriented forwardly of the frictional abutment 18 whose edge is positioned below and rearwardly of the aligned apertures 15.

A modified tissue dispenser 10*a* is illustrated in FIG. 4 including spaced lower side legs 20 mounted to the forward terminal ends of each of the side legs 16. The spaced lower side legs 20 include forward terminal ends mounting a cutter bar 22 aligned parallel to the axle 14. The cutter bar 22 includes a plurality of U-shaped grasp plates 23 extending laterally and overlying the cutter bar. Each grasp plate 23 includes a concave engagement recess 24 wherein an individual may position a finger to lift the arm and associated roll 3 for engagement relative to the engagement edge 19 to permit a free dispensing of the free and portion 3*a* of the tissue roll 3. Subsequently, the roll 3 may be repositioned upon the engagement edge 19 whereupon downward pressure upon the cutter bar 22 effects a separation of a free end portion 3*a* from the tissue roll 3.

The cutter bar 22 (see FIG. 5) includes spaced side plates 25 orthogonally mounted to a top plate 29 that includes a forward serrated edge 26. The serrated edge 26 is aligned parallel to the axle 14.

The side plates 25 prevent inadvertent access of an individual's hand or finger from engagement with the cutter bar 22. A plurality of fasteners 28 as is exemplified in FIG. 9 mount the cutter bar 22 to the forward terminal ends 21 of the lower side legs 20. Let it be noted that the lower side legs 20 are integrally and fixedly mounted to the lower terminal ends of the side legs 16 and include an obtuse angle defined therebetween as illustrated in FIG. 4 for example.

FIGS. 8 and 9 illustrate a modified cutter bar 22*a* including a reversible concave polymeric strip 30 fixedly mounted to a forward edge of a top plate 29 whose forward side edge 31 overlies the forward serrated edge 26. Upon downward pressure of the free end portion 3*a* of the tissue roll 3, the forward side edge 31 is displaced providing access of the tissue free end portion 3*a* to the serrated edge 26. Otherwise, the forward side edge 31 acts as a brake to also prevent unwarranted and undesirable unwinding of the tissue. The rear side edge 32, arranged parallel to the forward side edge 31 is of an equal configuration to that of the forward side edge 31 wherein upon removal of the strip fasteners 33, the strip 30 may be reversed side for side to position the rear side edge 32 overlying and spaced above the forward serrated edge 26 upon damage or wear to the forward side edge 31.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, the include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tissue dispenser comprising in combination, a "U" shaped support frame, the "U" shaped support frame including spaced parallel side legs and a single base leg mounted orthogonally to rear terminal ends of each side leg, the base leg mounted within a bracket means, the bracket means arranged for securement of the base leg to a vertical support surface, and each side leg including a forward end, and an aperture directed through each side leg adjacent each forward end, and the aperture of each side leg coaxially aligned relative to one another, wherein the apertures are oriented parallel to the base leg, and a tissue support axle mounted to the aligned apertures, and the support axle arranged for securement of a tissue roll rotatably thereon, the tissue roll including a free end portion directed forwardly of the tissue roll, and an abutment means is mounted to the support surface positioned vertically below and rearwardly of the aligned apertures for abutment of the tissue roll, and wherein the abutment means includes an elongate abutment member of a triangular cross-sectional configuration including an elongate engagement edge oriented forwardly of the abutment means for engagement of a rear surface of the tissue roll wherein an engagement is positioned below and rearwardly of the tissue support axle and forwardly of the support surface, and further including a lower side leg integrally mounted to each forward terminal end of each side leg, each lower side leg defining an obtuse angle between the lower side leg and the side leg, and each lower side leg including a lower side leg forward terminal end, and a cutter bar mounted into the forward terminal end of each lower side leg, and wherein the cutter bar further includes a plate member with a forward serrated edge formed thereon, the forward serrated edge aligned parallel to and below the support axle, and the plate member including a side plate orthogonally mounted and coextensive with each plate member, and each side plate including a rear plate coextensively mounted to the plate member and integrally mounted to each side plate orthogonally thereto, and the side plates each including a "U" shaped grasp plate integrally and orthogonally mounted in a spaced relationship above each plate member, each grasp plate including a concave engagement recess to provide an engagement surface for a finger portion of a user to displace the "U" shaped support frame relative to the engagement edge, and further including a flexible concave polymeric strip mounted onto the plate member, the polymeric strip of a flexible memory retentent construction including a forward side edge spaced above and overlying the serrated edge and displaceable therefrom upon application of the free end portion of the tissue roll against the serrated edge.

2. A dispenser as set forth in claim 1 wherein the flexible strip includes a rear side edge spaced parallel to the forward side edge, the rear side edge and forward side edge spaced above the plate member, and a plurality of strip fasteners mounting the flexible strip to the plate member to permit reversing of the flexible strip relative to the plate member to enable positioning of the rear side edge to overlie the serrated edge.

3. A dispenser as set forth in claim 2 wherein the flexible strip is of a concave cross-sectional configuration.

* * * * *